US005993498A

United States Patent [19]

Vrahopoulou et al.

[11] Patent Number: 5,993,498

[45] Date of Patent: Nov. 30, 1999

[54] POLYOL ESTER DISTILLATE FUELS ADDITIVE

[75] Inventors: Elisavet P. Vrahopoulou, Chatham; Richard Henry Schlosberg, Bridgewater, both of N.J.; David Wayne Turner, Baton Rouge, La.

[73] Assignee: Exxon Research and Engineering Co., Florham Park, N.J.

[21] Appl. No.: 09/054,579

[22] Filed: Apr. 3, 1998

Related U.S. Application Data

[63] Continuation-in-part of application No. 08/712,990, Sep. 13, 1996, abandoned.

[51] Int. Cl.[6] ..... C10L 1/18

[52] U.S. Cl. ..... 44/388; 44/389; 44/398; 44/400

[58] Field of Search ..... 44/388, 389, 398, 44/400

[56] References Cited

U.S. PATENT DOCUMENTS

| | | | |
|---|---|---|---|
| 2,527,889 | 10/1950 | Moore | 44/389 |
| 4,032,304 | 6/1977 | Dorer, Jr. et al. | 44/389 |
| 4,604,102 | 8/1986 | Zaweski et al. | 44/389 |
| 4,920,691 | 5/1990 | Fainman | 44/389 |
| 5,004,478 | 4/1991 | Vogel | 44/398 |

FOREIGN PATENT DOCUMENTS

| | | |
|---|---|---|
| 275894 | 3/1992 | Czechoslovakia . |
| 0608149 | 7/1994 | European Pat. Off. . |
| 9623855 | 8/1996 | WIPO . |

*Primary Examiner*—Dephia D. Toomer
*Attorney, Agent, or Firm*—Paul E. Purwin

[57] ABSTRACT

A polyol ester distillate fuel additive exhibits improved lubricity and friction and wear performance. The ester has between about 1% and about 35% unconverted hydroxyl groups and is characterized as having a hydroxyl number from about 5 to about 180.

26 Claims, No Drawings

POLYOL ESTER DISTILLATE FUELS ADDITIVE

This application is a C-I-P of U.S. Ser. No. 08/712,990, filed Sep. 13, 1996, now abandoned.

FIELD OF THE INVENTION

The present invention relates generally to a polyol ester additive for distillate fuel applications and more particularly to a distillate fuel additive comprising a partially esterified polyol ester which exhibits improved lubricity and wear and frictional performance of the materials it contacts. The polyol ester fuels additives of this invention have unconverted hydroxyl groups from the reaction product of a polyol with a branched or linear saturated acid, or of a polyol with a polybasic acid and a monoalcohol.

BACKGROUND OF THE INVENTION AND DISCUSSION OF THE PRIOR ART

The formulation of distillate fuels for internal combustion engines has become increasingly sophisticated and complex. Basic diesel fuels are tailored through additives aimed to reduce fuel hazing, particulate and gaseous emissions, inhibit corrosion, reduce deposits and more pertinent hereto, improve lubricity. Driven by demanding regulatory requirements in the U.S. and Europe, increasingly severe specifications have been imposed to diesel fuels, particularly with respect to sulfur content and in some areas aromatic content. For example, in 1991, clean burn, Class 1 diesel fuels were introduced in Sweden; these fuels contain less than 10 ppm sulfur and less than 5% vol. aromatics. In the United States, the Environmental Protection Agency promulgated a regulatory sulfur content in diesel fuels which was limited to 0.05% wt. commencing in 1993. Similar reductions in sulfur will occur in Japan in 1997.

Removal of sulfur compounds and hydrotreating of distillate fuels, in combination with increasing injection pressures in fuel systems in modern engines, have caused concerns over lack of fuel lubricity. This could lead to problems of excessive wear of fuel-lubricated components such as fuel pumps, fuel injectors, etc. The present invention provides a distillate fuel additive which exhibits improved lubricity, and wear and frictional performance.

Esters have generally excellent thermal and oxidative stability characteristics, and have been widely used in synthetic or partially synthetic crankcase lubricants. The art has recently recognized the potential role esters may serve as fuel additives. For example U.S. Pat. No. 5,366,519 discloses the use of certain polyoxyalkylene hydroxylaromatic esters as fuels additives, including diesel fuels, to reduce engine deposits.

The prior art also teaches that high molecular weight esters may survive the combustion in the cylinder and thereby be available to provide surficial lubricant benefit to the cylinder walls and piston rings while low molecular weight esters provide detergency benefits such as reduced injector deposits. U.S. Pat. No. 4,920,691 teaches a combination of a low molecular weight straight chain carboxylic acid ester, i.e., molecular weight less than 200, and a high molecular weight straight chain carboxylic acid ester, i.e., molecular weight ranging from 300 to 1000 to achieve both detergency benefits and cylinder wall lubrication. In addition to increasing the cost of the fuel, it has been recognized that the amount of detergent additives need be minimized because of the deleterious effects the by-products of such additives have on crankcase lubricants; see, for example, U.S. Pat. No. 5,004,478. Small amounts of the by-product of these additives, upon breakdown in the combustion chamber, wind up in the crankcase lubricant and contribute to engine oil breakdown.

SUMMARY OF THE INVENTION

The present inventors have developed a unique distillate additive for diesel fuel, jet fuel, kerosene and mixtures thereof which employs a polyol ester synthesized from a polyol and branched acid, linear saturated acid, or mixtures thereof in such a manner that the resulting ester has unconverted hydroxyl groups. The ester may also be sythesized from a polyol and a polybasic acid. The resultant fuel composition displays improved lubricity and reduced wear and friction. The ester comprises the reaction product of an alcohol having the general formula $R(OH)_n$ where R is an aliphatic group, cyclo-aliphatic group, or a combination thereof having from about 2 to 20 carbon atoms and n is at least two where the aliphatic group is branched or linear; and, at least one branched or linear acid. The ester has at least 1% unconverted hydroxyl groups based upon the total amount of hydroxyl groups in the alcohol and is being characterized by hydroxyl numbers ranging from greater than about 5 to about 180 and preferably greater than about 5 to about 140. The fuels referred to in this invention generally comprise distillate fuels, and typically comprise a major amount of diesel fuel, jet fuel, kerosene or mixtures thereof; the distillate fuel may also be synthesized by the Fischer-Tropsch method or the like. The ester additive comprises a minor amount of the fuel, ranging from about 10 to about 10,000 wppm.

DETAILED DESCRIPTION OF THE INVENTION

The fuel composition of the present invention employs a polyol ester which comprises a compound represented by the general formula $R(OOCR')_n$ and at least one of the following compounds:

$R(OOCR')_{n-1}OH$, $R(OOCR')_{n-2}(OH)_2$, and $R(OOCR')_{n-(i)}(OH)_{(i)}$ where n is an integer having a value of at least 2, R is an aliphatic group or cycloaliphatic hydrocarbyl group or combination thereof containing from about 2 to about 20 or more carbon atoms, R' is a branched or linear hydrocarbyl group having a carbon number in the range between about $C_2$ to $C_{20}$, and (i) is an integer having a value in the range of 0 to n. Unless previously removed, the polyol ester composition may also include excess $R(OH)_n$.

The ester is preferably formed by reacting a polyhydroxyl compound (i.e., polyol) with at least one branched acid or linear saturated acid or mixtures thereof. The polyol is preferably present in an excess of about 10 to 35 percent or more for the amount of acid used in the reaction. The composition of the feed polyol is adjusted so as to provide the desired composition of the product ester.

The esterification reaction is preferably conducted, with or without a catalyst, at a temperature in the range of about 140° C. to about 250° C. and a pressure ranging from about 30 mm Hg to 760 mm Hg for about 0.1 to 12 hours, preferably 1 to 8 hours. In a preferred embodiment, the reactor apparatus may vacuum strip excess acid to provide the preferred final composition. The product may then be treated in a contact process step by contacting it with a solid such as alumina, zeolite activated carbon, or clay, for example.

In another embodiment, the fuel composition of the present invention employs an ester which comprises a compound represented by the general formula $R(OOC(CH_2)_xCOOR')_n$ and at least one of the following compounds:

$R(OOC(CH_2)_xCOOR')_{n-1}OH$ $R(OOC(CH_2)_xCOOR')_{n-2}(OH)_2$, and $R(OOC(CH)_xCOOR')_{n-i}(OH)_{(i)}$ In this embodiment, the ester is an ester of a polyol with a polybasic acid. In a preferred embodiment, the polybasic acid is capped with a monoalcohol such as any linear or branched $C_1$–$C_{18}$ alcohol and preferably a branched $C_6$–$C_{13}$ alcohol.

Alcohols

Among the alcohols which may be utilized in the reaction with the branched acid(s) and/or linear acid(s) are polyhydroxyl compounds represented by the general formula:

$R(OH)_n$ where R is an aliphatic group or cyclo-aliphatic group or a combination thereof where the aliphatic group is branched or linear, and n is at least 2. The hydrocarbyl group may contain from about 2 to about 20 or more carbon atoms and is preferably an alkyl group. The hydroxyl groups may be separated by one or more carbon atoms.

The polyhydroxyl compounds generally may contain one or more oxyethylene groups and accordingly include compounds such as polyether polyols.

The following alcohols are particularly useful as polyols in the practice of the present invention: neopentyl glycol, 2,2-dimethylol butane, trimethylol ethane, trimethylol butane, mono-penaerythritol, technical grade pentaerythritol, di-pentaerythritol, tri-pentaerythritol, ethylene glycol, propylene glycol and polyalkylene glycols (e.g., polyethylene glycols, polypropylene glycols, 1,4-butanediol, sorbitol and the like, 2-methylpropanediol, polybutylene glycols, etc., and blends thereof such as an oligomerized mixture of ethylene glycol and propylene glycol). The most preferred alcohols are technical grade (e.g., approximately 88% mono-, 10% di- and 1–2% tri-pentaerythritol) pentaerythritol, monopentaerythritol, di-pentaerythritol, neopentyl glycol and trimethylol propane.

Branched Acids

The branched acid is preferably a mono-carboxylic acid which has a carbon number in the range between about $C_4$ to $C_{20}$, more preferably about $C_5$ to $C_{10}$ wherein methyl or ethyl branches are preferred. The mono-carboxylic acid is preferably at least one acid selected from the group consisting of: 2,2-dimethyl propionic acid (neopentanoic acid), neoheptanoic acid, neooctanoic acid, neononanoic acid, isopentanoic acid, iso-hexanoic acid, neodecanoic acid, 2-ethyl hexanoic acid (2EH), 3,5,5-trimethyl hexanoic acid (TMH), isoheptanoic acid, isooctanoic acid 2- methylbutyric acid, isononanoic acid and isodecanoic acid. One particularly preferred branched acid is 3,5,5-trimethyl hexanoic acid. The term "neo" as used herein refers to a trialkyl acetic acid, i.e., an acid which is triply substituted at the alpha carbon with alkyl groups. These alkyl groups are equal to or greater than $CH_3$ as shown in the general structure set forth here below:

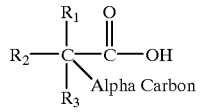

wherein $R_1$, $R_2$, and $R_3$ are greater than or equal to $CH_3$ and not equal to hydrogen.

3,5,5-trimethyl hexanoic acid has the structure set forth herebelow:

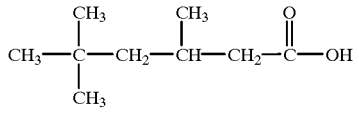

Branched Oxo Acids

The branched oxo acid is preferably a mono-carboxylic oxo acid which has a carbon number in the range between about $C_5$ to $C_{10}$, preferably $C_7$ to $C_{10}$, wherein methyl branches are preferred. The mono-carboxylic oxo acid is at least one acid selected from the group consisting of: iso-pentanoic acids, iso-hexanoic acids, iso-heptanoic acids, iso-octanoic acids, iso-nonanoic acids, and iso-decanoic acids. One particularly preferred branched oxo acid is an isooctanoic acid known under the tradename Cekanoic®8 acid, commercially available from Exxon Chemical Company.

Another particularly preferred branched oxo acid is 3,5,5 trimethylhexanoic acid, a form of which is also commercially available from Exxon Chemical Company under the tradename Cekanoic®9 acid.

The term "iso" is meant to convey a multiple isomer product made by the oxo process. It is desirable to have a branched oxo acid comprising multiple isomers, preferably more than 3 isomers, most preferably more than 5 isomers.

Branched oxo acids may be produced in the so-called "oxo" process by hydroformylation of commercial branched $C_4$–$C_9$ olefin fractions to a corresponding branched $C_5$–$C_{10}$ aldehyde-containing oxonation product. In the process for forming oxo acids it is desirable to form an aldehyde intermediate from the oxonation product followed by conversion of the crude oxo aldehyde product to an oxo acid.

In order to commercially produce oxo acids, the hydroformylation process is adjusted to maximize oxo aldehyde formation. This can be accomplished by controlling the temperature, pressure, catalyst concentration, and/or reaction time. Thereafter, the demetalled crude aldehyde product is distilled to remove oxo alcohols from the oxo aldehyde which is then oxidized according to the reaction below to produce the desired oxo acid:

$$RCHO+\tfrac{1}{2}O_2 \rightarrow RCOOH \quad (1)$$

where R is a branched alkyl group.

Alternatively, oxo acids can be formed by reacting the demetalled crude aldehyde product with water in the presence of an acid-forming catalyst and in the absence of hydrogen, at a temperature in the range between about 93 to 205° C. and a pressure of between about 0.1 to 6.99 Mpa, thereby converting the concentrated aldehyde-rich product to a crude acid product and separating the crude acid product into an acid-rich product and an acid-poor product.

The production of branched oxo acids from the cobalt catalyzed hydroformylation of an olefinic feedstream preferably comprises the following steps:

(a) hydroformylating an olefinic feedstream by reaction with carbon monoxide and hydrogen (i.e., synthesis gas) in the presence of a hydroformylation catalyst under reaction conditions that promote the formation of an aldehyde-rich crude reaction product;

(b) demetalling the aldehyde-rich crude reaction product to recover therefrom the hydroformylation catalyst and a substantially catalyst-free, aldehyde-rich crude reaction product;

(c) separating the catalyst-free, aldehyde-rich crude reaction product into a concentrated aldehyde-rich product and an aldehyde-poor product;

(d) reacting the concentrated aldehyde-rich product either with (i) oxygen (optionally with a catalyst) or (ii) water in the presence of an acid-forming catalyst and in the absence of hydrogen, thereby converting the concentrated aldehyde-rich product into a crude acid product; and (e) separating the crude acid product into a branched oxo acid and an acid-poor product.

The olefinic feedstream is preferably any $C_4$ to $C_9$ olefin, more preferably a branched $C_7$ olefin. Moreover, the olefinic feedstream is preferably a branched olefin, although a linear olefin which is capable of producing all branched oxo acids are also contemplated herein. The hydroformylation and subsequent reaction of the crude hydroformylation product with either (i) oxygen (e.g., air), or (ii) water in the presence of an acid-forming catalyst, is capable of producing branched $C_5$ to $C_{10}$ acids, more preferably branched $C_8$ acid (i.e., Cekanoic®8 acid). Each of the branched oxo $C_5$ to $C_{10}$ acids formed by the conversion of branched oxo aldehydes typically comprises, for example, a mixture of branched oxo acid isomers, e.g., Cekanoic®8 acid comprises a mixture of 26 wt % 3,5-dimethyl hexanoic acid, 19 wt % 4,5-dimethyl hexanoic acid, 17 wt % 3,4-dimethyl hexanoic acid, 11 wt % 5-methyl heptanoic acid, 5 wt % 4-methyl heptanoic acid, and 22 wt % of mixed methyl heptanoic acids and dimethyl hexanoic acids.

Any type of catalyst known to one of ordinary skill in the art which is capable of converting oxo aldehydes to oxo acids is contemplated by the present invention. Preferred acid-forming catalysts are disclosed in co-pending and commonly assigned U.S. patent application, Ser. No. 08/269,420 (Vargas et al.), filed on Jun. 30, 1994, and which is incorporated herein by reference. It is preferable if the acid-forming catalyst is a supported metallic or bimetallic catalyst. One such catalyst is a bimetallic nickel-molybdenum catalyst supported on alumina or silica alumina which catalyst has a phosphorous content of about 0.1 wt % to 1.0 wt %, based on the total weight of the catalyst. Another catalyst can be prepared by using phosphoric acid as the solvent for the molybdenum salts which are impregnated onto the alumina support. Still other bimetallic, phosphorous-free Ni/Mo catalyst may be used to convert oxo aldehydes to oxo acids.

Linear Acids

The preferred mono-carboxylic linear acids are any linear saturated alkyl carboxylic acid having a carbon number in the range between about $C_2$ to $C_{20}$, preferably $C_2$ to $C_{10}$. Some examples of linear saturated acids include acetic, propionic, n-pentanoic, n-heptanoic, n-octanoic, n-nonanoic, and n-decanoic acids.

Some examples of polybasic acids include adipic, succinic, azelaic, sebacic, and dodecanedioic acid or mixtures thereof.

High Hydroxyl Esters

The high hydroxyl ester employed in the present invention has from about 1% to about 35% unconverted hydroxyl groups, based upon the total amount of hydroxyl groups in the alcohol. A common technique for characterizing the conversion of hydroxyl groups is hydroxyl number. A standard method for measuring hydroxyl number is detailed by the American Oil Chemists Society as A.O.C.S., Cd 13–60. The ester of the present invention is characterized as having hydroxyl numbers ranging from about greater than 5 to about 180. The term "high hydroxyl," as used herein, refers to partially esterified esters characterized as having a hydroxyl number greater than about 5.

Fuels Additive

The high hydroxyl ester product of this invention can be used as a distillate fuel additive by itself or in conjunction with other fuels additives such as detergents, anti-oxidants, corrosion inhibitors, pourpoint depressants, color stabilizers, carrier fluids, solvents, cetane improvers and the like. The foregoing additive may provide a multiplicity of effects and is included herein to illustrate that the high hydroxyl ester of the present invention may be complimented by such additives. This approach is well known in the relevant art.

The present invention is preferably suitable as a distillate fuel additive wherein distillate fuel covers jet, kerosene and diesel fuels and mixtures thereof. The distillate fuel may also comprise a fuel synthesized by the Fischer-Tropsch method and the like. The present invention also comprises a method for improving lubricity and reducing wear and friction in diesel engines by operating the engines with a fuel containing the partially esterified ester.

The following examples describe specific formulations of high hydroxyl esters in distillate fuel, embodying the present invention.

EXAMPLE 1

A high hydroxyl polyol ester of technical grade pentaerythritol with a mixture of an isooctanoic acid (i.e., Cekanoic®8) and isononanoic acid, illustrative of the present invention, was prepared in the following manner.

| | | |
|---|---|---|
| Cekanoic ®8 acid | 360 grams | 2.5 moles |
| 3,5,5 trimethyhexanoic acid | 1975 grams | 12.5 moles |
| Technical grade pentaerythritol | 725 grams | 5 moles |

The above reactants were placed in an esterification reactor and heated to a maximum temperature of 220° C. under a nitrogen atmosphere. After 260 cc of water were removed, vacuum stripping was begun to remove any unreacted acid. A neutralization of trace amount of acid with sodium carbonate solution followed by flashing water overhead and a final treatment with carbon/clay mixture was performed. The product was then filtered through dicalite and a yield of 2545 grams was obtained. The resulting ester compound exhibited a viscosity of 177.8 cSt at 40° C. and 13.37 cSt at 100° C. and Hydroxyl Number of 123.

EXAMPLE 2

A high hydroxyl polyol ester of trimethylol propane with adipic acid and capped with isodecyl alcohol was prepared utilizing:

| | |
|---|---|
| Trimethylol Propane | 1.0 mole |
| Adipic Acid | 2.75 moles |
| Isodecyl alcohol | 3.03 moles |

The resulting ester compound exhibited a viscosity of 165.3 cSt at 40° C. and 21.45 cSt at 100° C., and a Hydroxyl Number of 18.

One of the important aspects of this invention is its lubricity and improved wear and friction performance. A Ball on Cylinder Test, referred to as Scuffing BOCLE test, was used to evaluate the lubricity of the fuel additive of the present invention and compare it to known fuel additives. The procedures of the BOCLE test are substantially as set forth in the U.S. Army scuffing load test. This test is based on the ASTM 5001 method and is described in detail in "Draft Test Procedure for the U.S. Army Scuffing Load Wear Test" available from Belvoir Fuels and Lubricants Research Facility, Southwest Research Institute, P.O. Drawer 28510, San Antonio, Tex. 78228-0510. In the BOCLE testing, a minimum load (measured in grams) required to cause adhesive scuffing between a stationary ball and a fluid wetting rotating ring is identified. Table 1 shows the results of the BOCLE testing for several high hydroxyl ester additives in three reference distillate fuels. Data for the fuel additives of the present invention are shown in comparison to both base liquid and base liquid with ester additives having low (<5) hydroxyl numbers. Base 1 is a commercial Class 1 Swedish diesel fuel. Base 2 is a Fischer-Tropsch synthetic distillate in the 250–500° F. range. Base 3 is an isoparaffinic solvent having a tradename of Isopar M, manufactured by Exxon Chemical Company. It is used as a reference fluid in the scuffing BOCLE test.

TABLE 1

| | Fuel | | Additive | Hydroxyl Number | Scuffing BOCLE Minimum Load (gr) |
|---|---|---|---|---|---|
| 1. | Base 1 | + | None | N/A | 1500 |
| 2. | Base 1 | + | 0.1% w/w ester of trimethylolpropane with 3,5,5-trimethyl hexanoic acid | 110 | 2400 |
| 3. | Base 1 | + | 0.1% w/w ester of trimethylolpropane with 3,5,5-trimethyl hexanoic acid | <5 | 1700 |
| 4. | Base 1 | + | 0.1% w/w ester of trimethylolpropane with linear $C_8/C_{10}$ acids | 54 | 2900 |
| 5. | Base 1 | + | 0.1% w/w ester of trimethylolpropane with linear $C_8/C_{10}$ acids (Priolube 3970[1]) | <5 | 2000 |
| 6. | Base 1 | + | 0.1% w/w ester of technical grade pentaerythritol with a mixture of Cekanoic ® 8 acid and linear $C_8/C_{10}$ acids | 123 | 3400 |
| 7. | Base 1 | + | 0.1% w/w ester of technical grade pentaerythritol with a mixture Cekanoic ® 8 acid and linear $C_8/C_{10}$ acids | <5 | 2100 |
| 8. | Base 1 | + | 0.1% w/w ester of trimethylolpropane with adipic acid capped with isodecyl alcohol | 18 | 4700 |
| 9. | Base 1 | + | 0.1% w/w ester of glycerol with Cekanoic[8] acid | 79 | 3000 |
| 10. | Base 1 | + | 0.1% w/w ester of glycerol with linear $C_8/C_{10}$ acids | 5.8 | 2100 |
| 11. | Base 1 | + | 0.1% w/w ester of glycerol with linear $C_8/C_{10}$ acids | 72 | 2900 |
| 12. | Base 2 | | None | N/A | 1700 |
| 13. | Base 2 | + | 0.1% w/w ester of trimethylolpropane with 3,5,5-trimethyl hexanoic acid | 110 | 2100 |
| 14. | Base 2 | + | 0.1% w/w ester of trimethylolpropane with 3,5,5-trimethyl hexanoic acid | <5 | 2400 |
| 15. | Base 3 | | None | N/A | 1300 |
| 16. | Base 3 | + | 0.01% w/w ester of technical grade pentaerythritol with a mixture of 3,5,5 trimethylhexanoic acid and Cekanoic ® 8 acid | 139 | 2800 |
| 17. | Base 3 | + | 0.1% w/w ester of technical grade pentaerythritol with a mixture of 3,5,5 trimethylhexanoic acid and Cekanoic ® 8 acid | 139 | 3000 |
| 18. | Base 3 | + | 1.0% w/w ester of technical grade pentaerythritol with a mixture of 3,5,5 trimethylhexanoic acid and Cekanoic ® 8 acid | 139 | 3900 |
| 19. | Base 3 | + | 0.01% w/w ester of trimethylolpropane with adipic acid capped with isodecyl alcohol | 18 | 2000 |
| 20. | Base 3 | + | 0.1% w/w ester of trimethylolpropane with adipic acid capped with isodecyl alcohol | 18 | 3200 |
| 21. | Base 3 | + | 1.0% w/w ester of trimethylolpropane with adipic acid capped with isodecyl alcohol | 18 | 4000 |

[1]Priolube 3970 is a trademark of Unichema, a commercially available ester.

What is claimed is:

1. A fuel composition for use in internal combustion engines comprising a major amount of distillate fuel and a minor amount of an ester comprising the reaction product of:

an alcohol having the general formula R(OH)n, where R is an aliphatic group, cycloaliphatic group, or combination thereof having from about 2 to 20 carbon atoms and n is at least 2 and where said aliphatic group is a branched or linear aliphatic group; and at least one branched and/or linear saturated acid which has a carbon number in the range between about $C_2$ to $C_{20}$, or a polybasic acid and mono alcohol; wherein said ester is characterized as having a hydroxyl number greater than about 5 to about 140; and, wherein said distillate fuel is selected from the group consisting of diesel fuel, kerosene, jet fuel, and a mixture thereof.

2. The fuel composition according to claim 1 wherein said saturated acid is a branched mono-carboxylic acid.

3. The fuel composition according to claim 2 wherein said branched mono-carboxylic acid is any mono-carboxylic acid having a carbon number in the range of about $C_4$ to $C_{20}$.

4. The fuel composition according to claim 3 wherein said branched mono-carboxylic acid has a carbon number in the range of about $C_5$ to $C_{10}$.

5. The fuel composition according to claim 2 wherein said acid is selected from the group consisting of 2,2-dimethyl propionic acid, neoheptanoic acid, neooctanoic acid, neononanoic acid, isopentanoic acid, iso-hexanoic acid, neodecanoic acid, 2-ethyl hexanoic acid, 3,5,5-trimethyl hexanoic acid, isoheptanoic acid, isooctanoic acid, isononanoic acid, 2-methylbutyric acid and isodecanoic acid, and mixtures thereof.

6. The fuel composition according to claim 2 wherein said branched mono-carboxylic acid is an isooctanoic acid.

7. The fuel composition according to claim 1 wherein said linear acid is any linear alkyl carboxylic acid having a carbon number in the range between about $C_2$ to $C_{20}$.

8. The fuel composition according to claim 7 wherein said linear acid is any linear alkyl carboxylic acid having a carbon number in the range between about $C_2$–$C_{10}$.

9. The fuel composition of claim 8 wherein said linear acid is selected from the group consisting of acetic, propionic, n-pentanoic, n-heptanoic, n-octanoic, n-nonanoic, and n-decanoic acids.

10. The fuel composition according to claim 1 wherein said alcohol is selected from the group consisting of: neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol, polyalkylene glycols, 1,4-butanediol, sorbitol, and 2-methylpropanediol, and mixtures thereof.

11. The fuel composition according to claim 1 wherein said polybasic acid is selected from the group consisting of: adipic acid, succinic acid, azelaic acid, sebacic acid, dodecanedioic acid and mixtures thereof.

12. The fuel composition of claim 1 wherein said ester composition comprises from about 10 wppm to about 10,000 wppm of said fuel composition.

13. A method for improving lubricity and reducing wear and friction in diesel engines comprising adding a minor amount of a partially esterified ester characterized by a hydroxyl number of greater than about 5 to about 140 a major amount of distillate fuel, and operating said engine utilizing said fuel and ester additive mixture, wherein said ester is the reaction product of an alcohol having the general formula $R(OH)_n$ where R is an aliphatic group, cycloaliphatic group, or combination thereof having from about 2 to about 20 carbon atoms and n is at least 2 where said aliphatic group is a branched or linear aliphatic group, and at least one branched and/or linear saturated acid having a carbon number from about $C_2$ to $C_{20}$ or a polybasic acid and mono alcohol.

14. The method according to claim 13 wherein said saturated acid is a branched mono-carboxylic acid.

15. The method according to claim 14 wherein said branched mono-carboxylic acid is any mono-carboxylic acid which has a carbon number in the range of about $C_4$ to $C_{20}$.

16. The method according to claim 15 wherein said branched mono-carboxylic acid has a carbon number in the range of about $C_5$ to $C_{10}$.

17. The method according to claim 16 wherein said acid is selected from the group consisting of 2,2-dimethyl propionic acid, neoheptanoic acid, neooctanoic acid, neononanoic acid, iso-hexanoic acid, neodecanoic acid, 2-ethyl hexanoic acid, isopentanoic acid, 3,5,5-trimethyl hexanoic acid, isoheptanoic acid, isooctanoic acid, isononanoic acid, 2 methylbutyric acid and isodecanoic acid and mixtures thereof.

18. The method according to claim 17 wherein said branched mono-carboxylic acid is an isooctanoic acid.

19. The method according to claim 14 wherein said linear acid is any linear alkyl carboxylic acid having a carbon number in the range between about $C_2$ to $C_{10}$.

20. The method of claim 19 wherein said linear acid is selected from the group consisting of acetic, propionic, pentanoic, n-heptanoic, n-octanoic, n-nonanoic, and n-decanoic acids.

21. The method according to claim 14 wherein said alcohol is selected from the group consisting of: neopentyl glycol, 2,2-dimethylol butane, trimethylol ethane, trimethylol propane, trimethylol butane, mono-pentaerythritol, technical grade pentaerythritol, di-pentaerythritol, tri-pentaerythritol, ethylene glycol, propylene glycol, polyalkylene glycols, 1,4-butanediol, sorbitol, and 2-methylpropanediol.

22. The method of claim 13 wherein said ester composition comprises from about 10 wppm to about 10,000 wppm of said fuel composition.

23. The method of claim 13 wherein said polybasic acid is selected from the group consisting of: adipic acid, succinic acid, azelaic acid, sebacic acid, dodecanedioic acid, and mixtures thereof.

24. The method of claim 23 wherein said polybasic acid is capped with a monoalcohol.

25. The method of claim 24 wherein said ester is an ester of trimethylolpropane with adipic acid capped with isodecyl alcohol.

26. A fuel composition for use in internal combustion engines comprising a major amount of distillate fuel and a minor amount of an additive which imparts improved lubricity, said additive including an ester consisting essentially of the following reaction product:

an alcohol having the general formula R(OH)n, where R is an aliphatic group, cycloaliphatic group, or combination thereof having from about 2 to 20 carbon atoms and n is at least 2 and where said aliphatic group is a branched or linear aliphatic group and at least one branched and/or linear saturated acid which has a carbon number in the range between about $C_2$ to $C_{20}$, or a polybasic acid and mono alcohol, wherein said ester is characterized as having a hydroxyl number greater than about 5 to about 140, and, wherein said distillate fuel is selected from the group consisting of diesel fuel, kerosene, jet fuel, and a mixture thereof.

* * * * *